US007477211B2

(12) United States Patent
Bezal et al.

(10) Patent No.: US 7,477,211 B2
(45) Date of Patent: Jan. 13, 2009

(54) DRIVER FOR A PLASMA DISPLAY PANEL

(75) Inventors: Jean-Raphaël Bezal, Meylan (FR); Gérard Morizot, Voiron (FR); Nicolas Dompnier, Poisat (FR)

(73) Assignee: Thomson Licensing, Boulogne-Billancourt (FR)

( * ) Notice: Subject to any disclaimer, the term of this patent is extended or adjusted under 35 U.S.C. 154(b) by 785 days.

(21) Appl. No.: 10/912,790

(22) Filed: Aug. 6, 2004

(65) Prior Publication Data

US 2005/0057445 A1 Mar. 17, 2005

(30) Foreign Application Priority Data

Aug. 7, 2003 (FR) ..... 03 09749

(51) Int. Cl.
*G09G 3/28* (2006.01)

(52) U.S. Cl. ..... 345/60; 345/62; 345/63; 345/68; 315/169.1; 315/169.3

(58) Field of Classification Search ..... 345/60, 345/63, 67, 690
See application file for complete search history.

(56) References Cited

U.S. PATENT DOCUMENTS 5,642,018 A * 6/1997 Marcotte ..... 315/169.4
6,160,531 A * 12/2000 Chen et al. ..... 345/60
7,009,588 B2 * 3/2006 Lee et al. ..... 345/68

FOREIGN PATENT DOCUMENTS

| | | |
|---|---|---|
| CN | 1203683 A | 12/1998 |
| EP | 1065694 | 1/2001 |
| JP | 57-208038 | 12/1982 |
| JP | 5-2900742 | 11/1993 |

OTHER PUBLICATIONS

Patent Abstracts of Japan, vol. 007, No. 062, Mar. 15, 1983 and JP 57-208038.
Patent Abstracts of Japan, vol. 018, No. 073, Feb. 7 1994 and JP 5-290742.
B. Slattery et al.: "Design and Layout of A Video Graphics System for Reduced EMI" Microprocessors and Microsystems, IPC Business Press Ltd., London, vol. 15, No. 2, Mar. 1, 1991, pp. 97-112.

* cited by examiner

*Primary Examiner*—Richard Hjerpe
*Assistant Examiner*—Jennifer T Nguyen
(74) *Attorney, Agent, or Firm*—Joseph J. Laks; Harvey D. Fried

(57) ABSTRACT

The invention relates to a driver for a plasma display panel. According to the invention, in order to reduce the current loops during the sustain of the display cells, a novel driver architecture is proposed. The switches of the sustain circuit, together with the switches, are disposed next to one another on the circuit board. In addition, the connectors accessing the display electrodes are placed, at the periphery of the board, on the same edge.

4 Claims, 7 Drawing Sheets

DRIVER FOR A PLASMA DISPLAY PANEL

This application claims the benefit, under 35 U.S.C. § 119 of French Patent Application 03/09749, filed Aug. 7, 2003.

FIELD OF THE INVENTION

The present invention relates to a driver for a plasma display panel.

BACKGROUND OF THE INVENTION

Currently, there are plasma display panel (hereafter referred to as PDP) drivers whose elements are divided between two boards, the elements for controlling the sustain electrodes Ys of the display cells being disposed on a first board and the elements for controlling the address-sustain electrodes Yas of the display cells being disposed on a second board.

SUMMARY OF THE INVENTION

The object of the invention is to reduce the size of the current loops in the driver in order to reduce the electromagnetic emissions.

Referring to FIG. 1 a typical means for controlling the sustain electrodes Ys of the display cells are assembled on a first board B1. Two switches I1 and I2 are connected in series between a power supply terminal T1 receiving the voltage Vs and a terminal T2 connected to ground. The voltage Vs denotes the peak voltage of the sustain pulse signal to be applied to the sustain electrodes Ys and to the address-sustain electrodes Yas of the display cells. The intermediate point situated between the switches I1 and I2 is connected to a connector CNI accessing the electrodes Ys of the display cells. In addition, a power-supply and decoupling capacitor C1 is connected across the terminals T1 and T2.

In a same manner, the means for controlling the sustain electrodes Yas of the display cells are assembled on a second board B2. Two switches I3 and I4 are connected in series between a power supply terminal T3 receiving the voltage Vs and a terminal T4 connected to ground. The intermediate point situated between the switches I3 and I4 is connected to a connector CN2 accessing the electrodes Yas of the display cells. In addition, a power-supply and decoupling capacitor C2 is connected across the terminals T3 and T4.

In the sustain phase, the switches I1 and I4 are firstly closed, then the switches I2 and I3 are closed. FIG. 2A shows the current loop present in the driver when the switches I1 and I4 are closed. The direction of the current in this loop is indicated by arrows. Similarly, FIG. 2B shows the loop of the current flowing in the driver when the switches I2 and I3 are closed.

In order to reduce the size of these current loops, one solution is to regroup the 2 parts of the driver onto a single board. This case is illustrated in FIG. 3. In this second driver, an energy recovery circuit, well-known to those skilled in the art, has been provided. All the elements of the driven in FIG. 1 are thus mounted on a single board, apart from the power supply terminal T3 and the ground terminal T4 that are not shown. The current loop between the recovery circuit and the display electrodes Ys and Yas is illustrated in FIG. 4A. Similarly, the current loops when the switches I1 and I4 on the one hand, and the switches I2 and I3 on the other, are closed are show in FIGS. 4B and 4C. The size of these loops is reduced with respect to those of the driver in FIG. 1, but they are still present even if the circuit is a hybrid circuit (with certain components being integrated).

The invention relates to a driver for a plasma display panel comprising a sustain circuit designed to deliver a first sustain pulse signal to the sustain electrodes of the cells of the said display and a second sustain pulse signal to the address-sustain electrodes of the display, the said sustain circuit comprising a first switch connected between a first connector accessing the sustain electrodes of the display cells and a power supply terminal receiving the peak voltage of the said first and second sustain pulse signals, a second switch connected between the said first access connector and ground, a third switch connected between a second connector accessing the address-sustain electrodes of the display cells and the said power supply terminal and a fourth switch connected between the said second access connector and ground, characterized in that it is mounted on a single board and in that the said first and fourth switches, and similarly the said second and third switches, are disposed next to one another in order to reduce the size of the current loops during the sustain of the display cells.

Advantageously, the said first and second access connectors are disposed at the periphery of the board, on the same edge next to one another in order to further reduce the size of the current loops.

According to a preferred embodiment, one of the access connectors is disposed on the kont face of the said board and the other on the back face. According to another embodiment, the said first and second access connectors are incorporated into a single connector.

BRIEF DESCRIPTION OF THE DRAWINGS

The invention will be better understood upon reading the description that follows, presented as a non-limiting example and with reference to the appended figures, among which.

DESCRIPTION OF PREFERRED EMBODIMENTS

Figure 1:
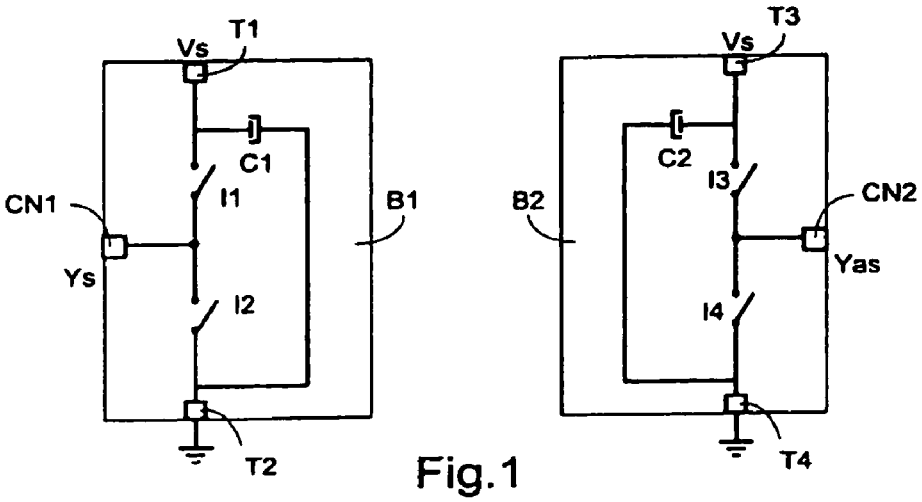
Prior Art Fig.1
FIG. 1, described above, shows a PDP driver of the prior art divided between 2 boards.
Figure 2A:
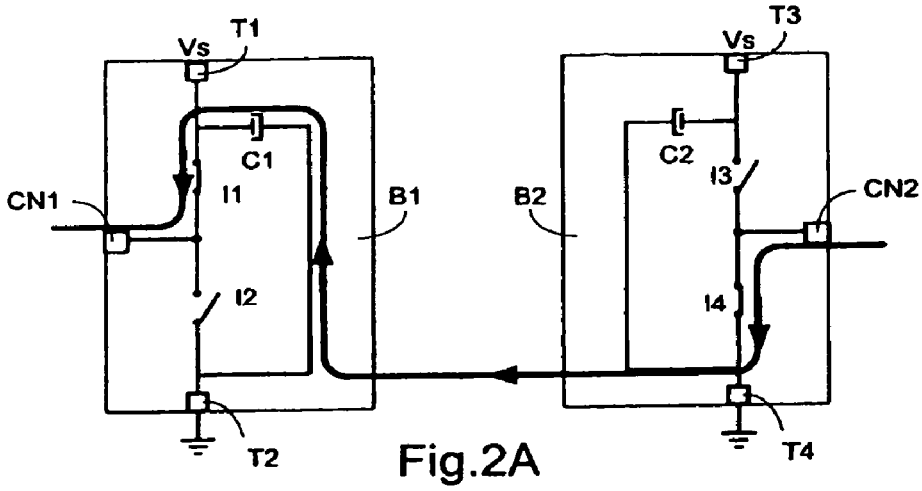
Prior Art Fig.2A
FIGS. 2A and 2B, described above, show the current loops in the circuit shown in FIG. 1.
Figure 2B:
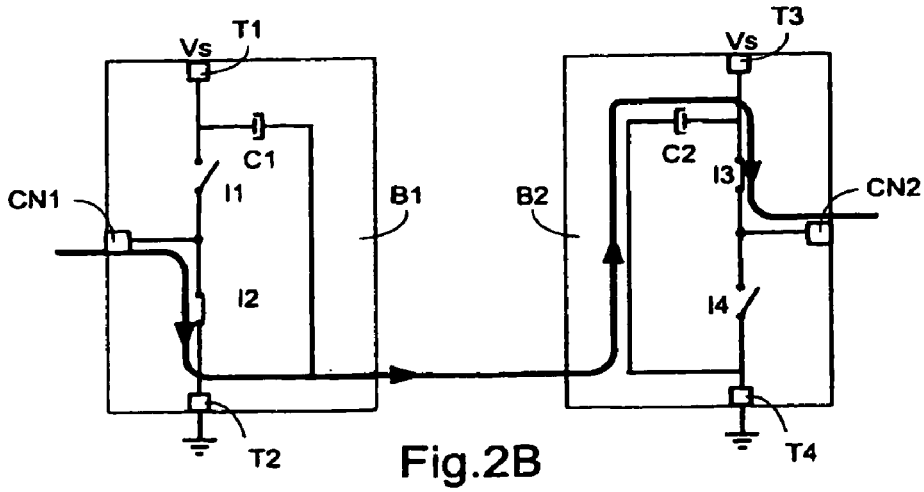
Prior Art Fig.2B
Figure 3:
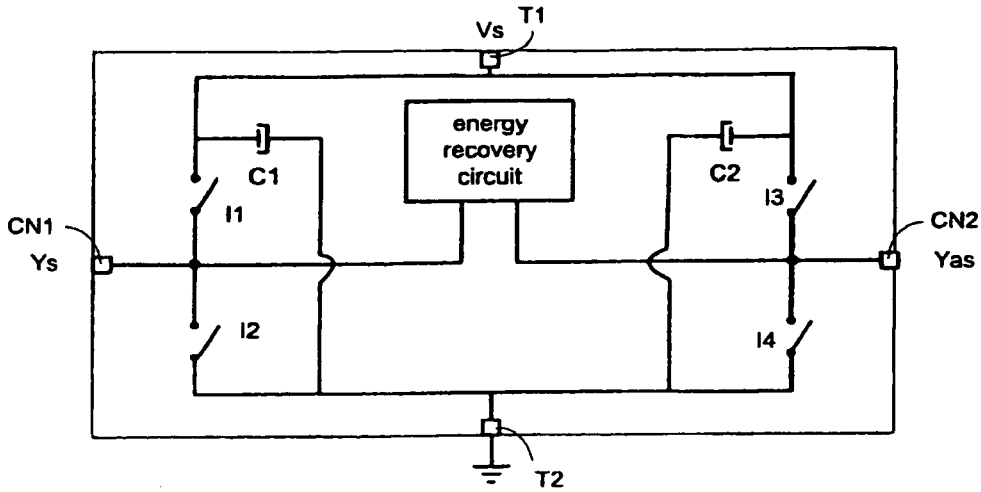
Prior Art Fig.3
FIG. 3, described above, shows a mono-board driver of the prior art.
Figure 4A:
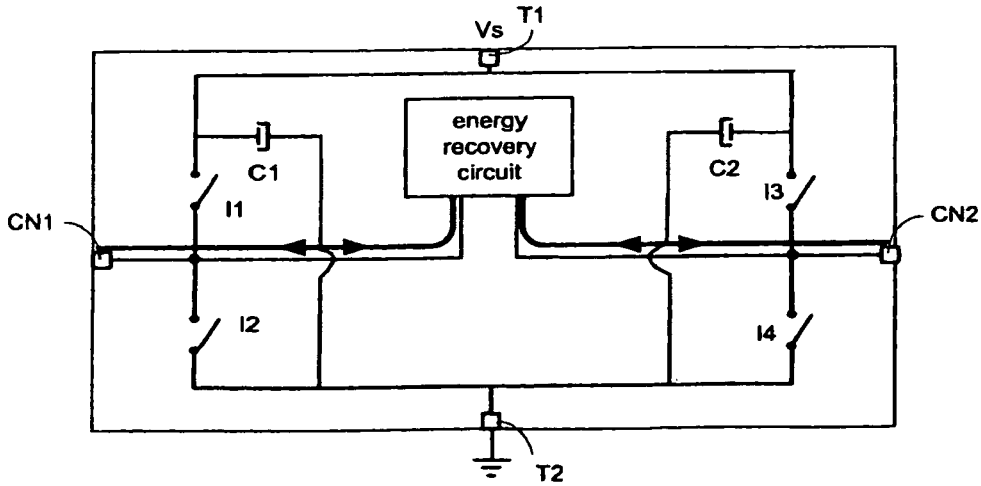
Prior Art Fig.4A
FIGS. 4A to 4C, described above, show the current loops in the circuit shown in FIG. 3.
Figure 4B:
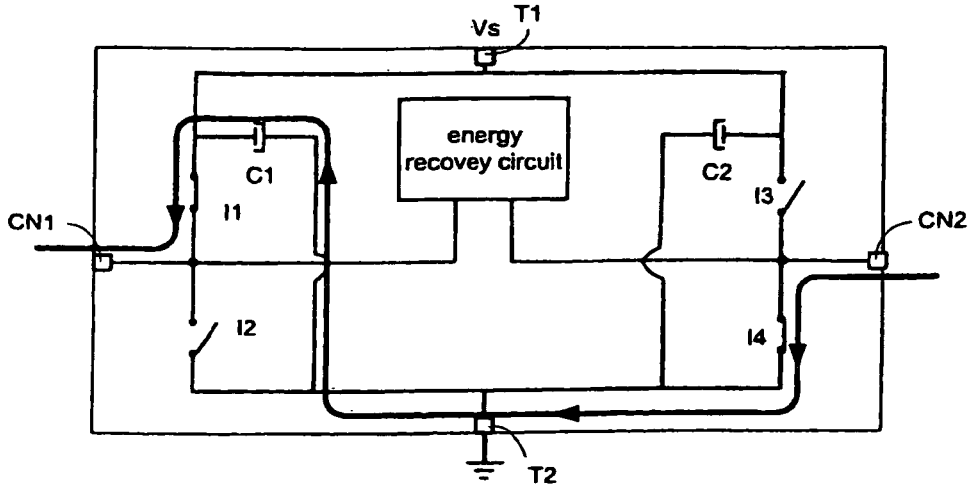
Prior Art Fig.4B
Figure 4C:
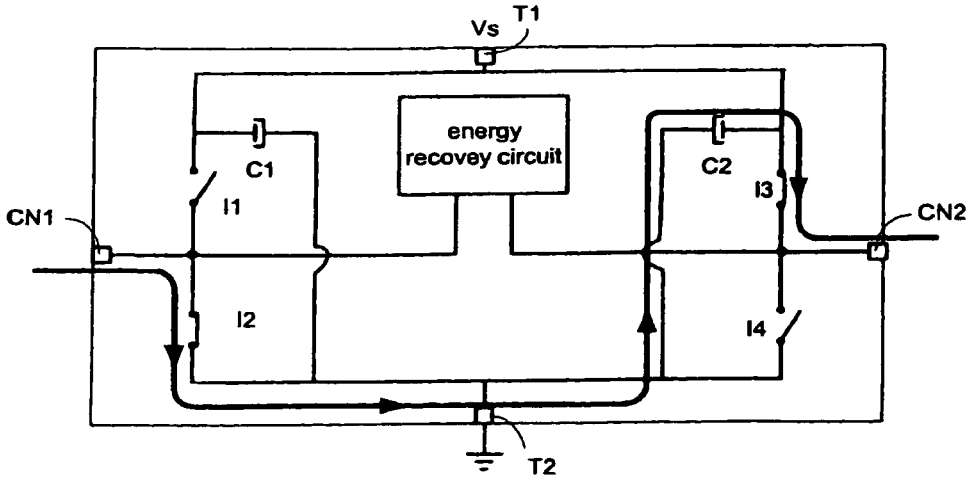
Prior Art Fig.4C
Figure 5A:
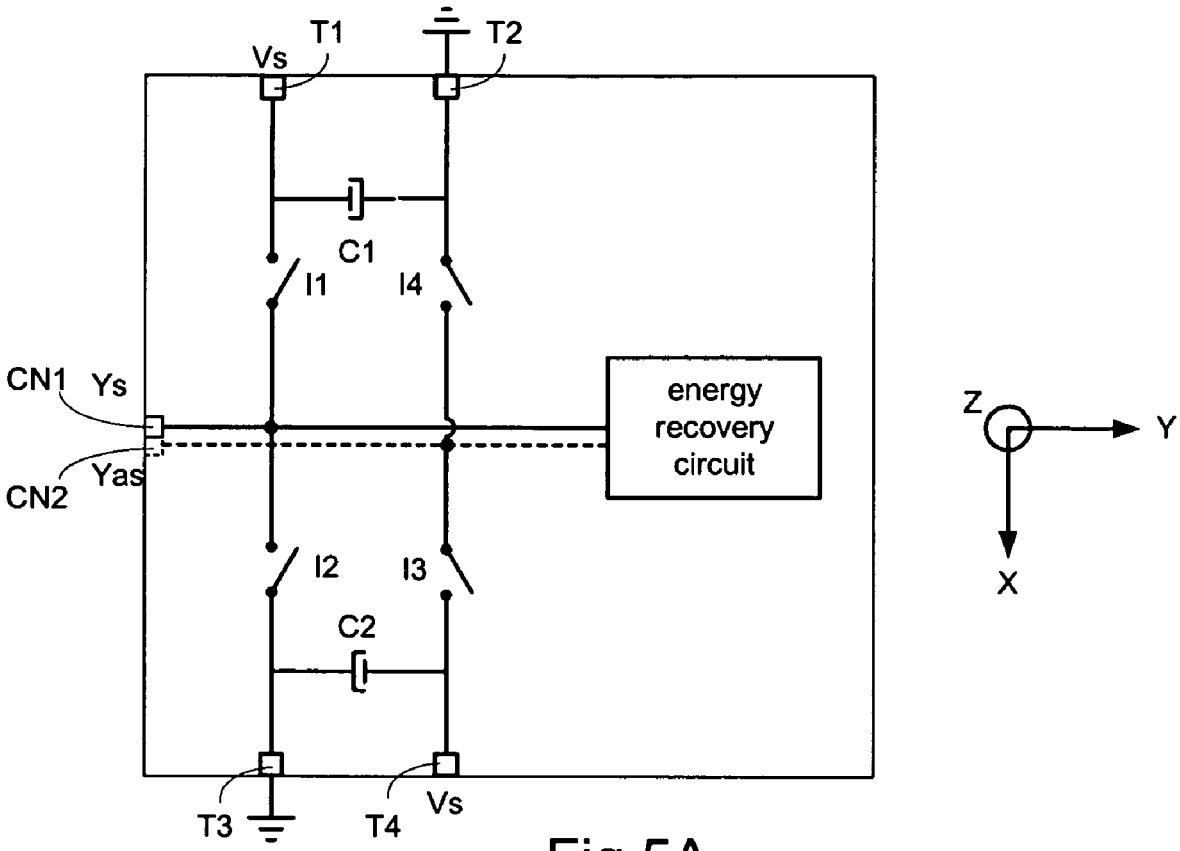
FIGS. 5A and 5B respectively show front and cross-sectional views of a driver according to the invention.
Figure 5B:
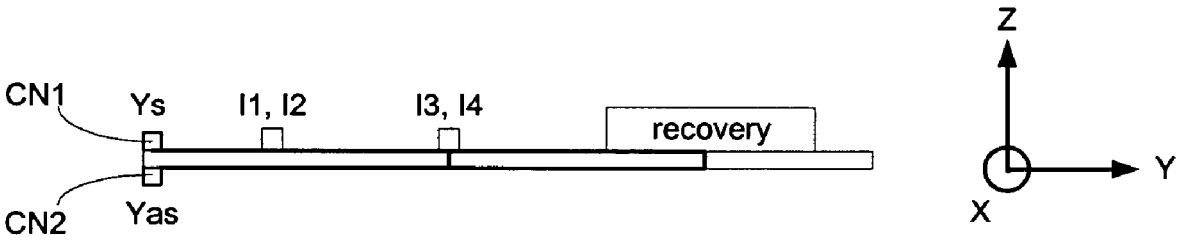

According to the invention, the position of the elements in the driver of the PDP is optimized in order to reduce the size of the loops in all three dimensions. FIG. 5A shows the driver of the invention in one plane (x,y) and FIG. 5B shows this same circuit in the plane (y, z).

In these figures, the switches I1 and I4 are positioned next to one another, at the same level on the x axis, so as to reduce the loop of the current flowing through them when closed. The same applies to the switches I2 and I3 in order to reduce the loop of the current flowing through them when closed.

Furthermore, the access connectors CN1 and CN2 are disposed, at the periphery of the board, next to one another on the same edge of the board, here on the left-hand edge of the board. Given that all the current loops pass through these two access connectors, this allows the size of these loops to be again reduced. In this preferred embodiment, the connector CN1 is located on the front face of the board and the connector CN2 is located, in the same position in the plane (x,y), on the back face. The track connecting the mid-point situated between the switches I2 and I3 to the connector CN2 is therefore made on the back face of the board together with the track connecting this mid-point to the energy recovery circuit. All the other circuit components and tracks are mounted on the front face of the board and a screw is, for example, provided for linking the track on the back face with the components on the front face.

Figure 6A:
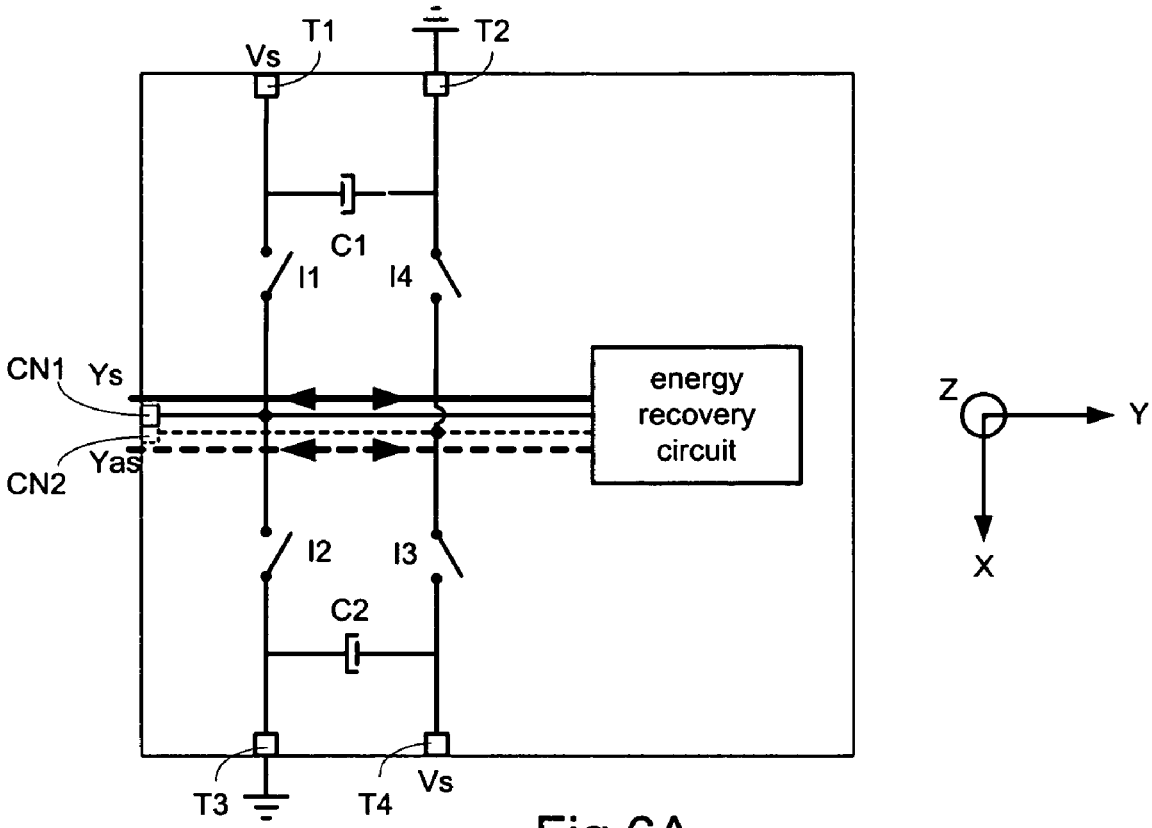
FIGS. 6A to 6F show the current loops in the circuit shown in FIGS. 5A and 5B.
Figure 6B:
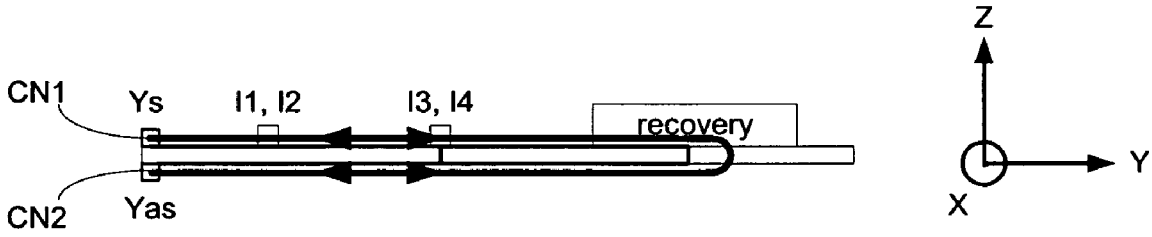
Figure 6C:
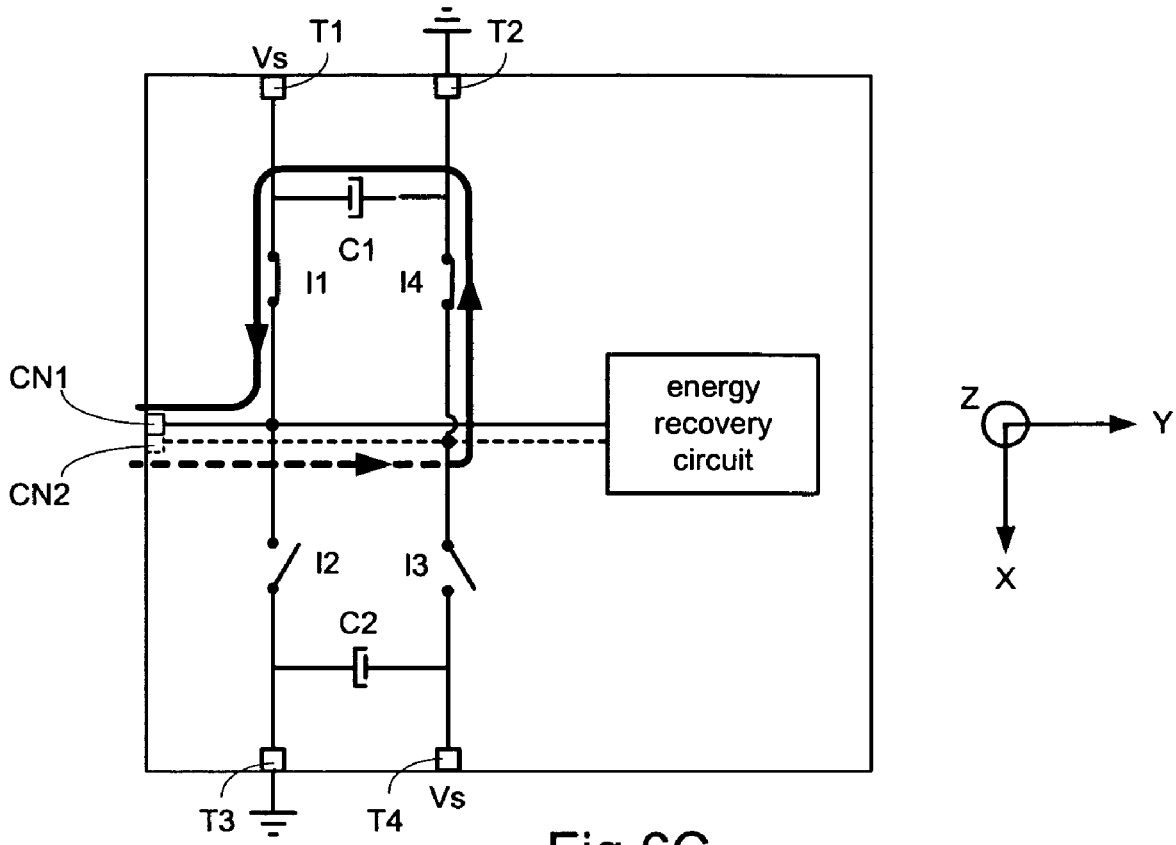
Figure 6D:
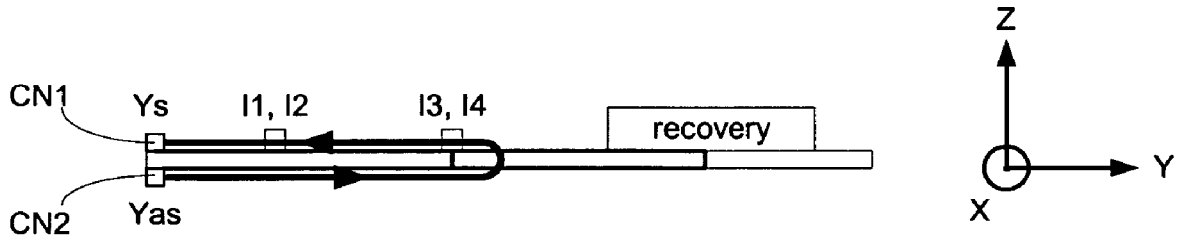
Figure 6E:
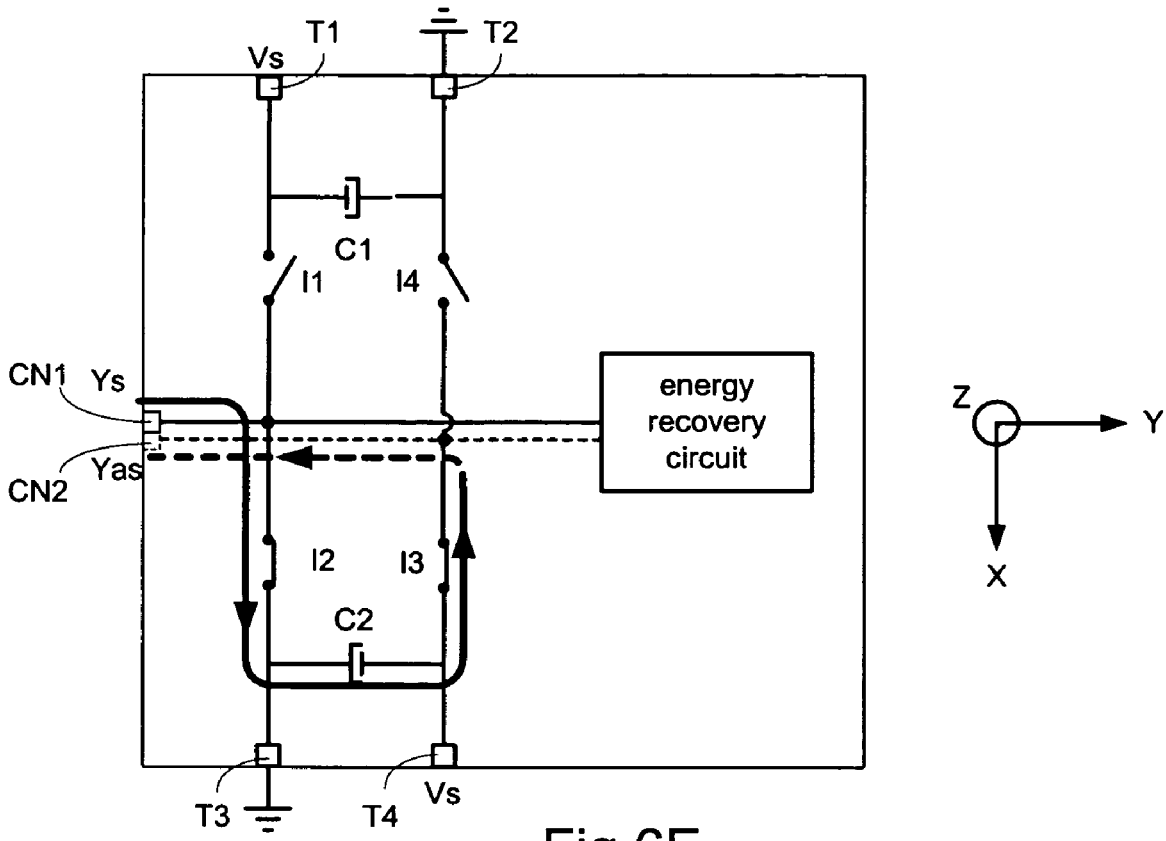
Figure 6F:
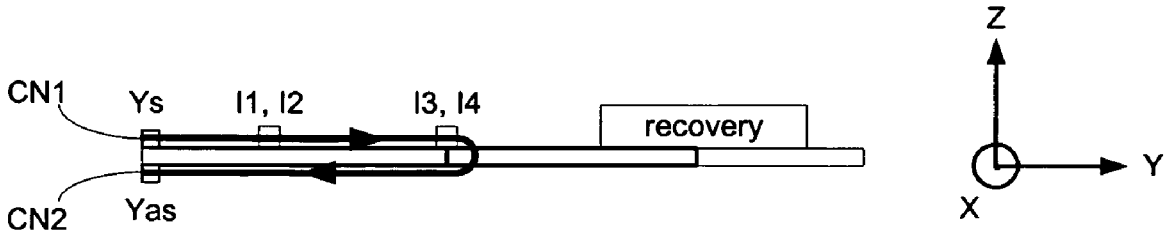

Accordingly, as can be seen from FIGS. 6A to 6F, the current loops are greatly reduced. FIGS. 6A and 6B show the current loop between the recovery circuit and the display electrodes Ys and Yas. FIGS. 6C and 6D show the loop of the current flowing through the switches I1 and I4 when these are closed. FIGS. 6E and 6F show the loop of the current flowing through the switches I2 and I3 when these are closed.

The size of the current loops in the z direction is greatly reduced and is essentially determined by the thickness of the board. In the plane (x,y), the size of the current loops is reduced if the switches I1 and I4, and also I2 and I3, are very close to one another and if they are disposed near to the access connectors CN1 and CN2. It should be noted that, in this figure, two power supply terminals T1 and T4 and two ground terminals T2 and T3 are shown in order to simplify the circuit diagram. It is clear that the provision of only one power supply terminal and one ground terminal is possible with additional tracks being used to link the elements connected to the missing terminals to these two terminals.

This solution is valid for an integrated circuit design or for one with discrete components. Near-field measurements demonstrated that the electromagnetic emissions were reduced relative to conventional circuits.

As a variant, the use of a single connector in place of the connectors CN1 and CN2 may be envisaged. In this case, some of the pins of this connector would be assigned to the electrodes Ys and the others to the electrodes Yas.

The invention claimed is:

1. A driver for a plasma display panel comprising a sustain circuit designed to deliver a first sustain pulse signal to the sustain electrodes of the cells of the said display and a second sustain pulse signal to the address-sustain electrodes of the display, said sustain circuit comprising a first switch connected between a first connector accessing the sustain electrodes of the display cells and a power supply terminal receiving the peak voltage of said first and second sustain pulse signals, a second switch connected between said first access connector and ground, a third switch connected between a second connector accessing the address-sustain electrodes of the display cells and said power supply terminal and a fourth switch connected between said second access connector and ground, wherein said driver is mounted on a single board and in that said first and fourth switches, and similarly said second and third switches, are disposed next to one another in order to reduce the size of the current loops during the sustain of the display cells.

2. Driver according to claim 1, wherein said first and second access connectors are disposed at the periphery of the board, on the same edge next to one another.

3. Driver according to claim 1, wherein one of the access connectors is disposed on the front face of the said board and the other on the back face.

4. Driver according to claim 1, wherein said first and second access connectors are incorporated into a single connector.

* * * * *